US009464604B2

(12) United States Patent
Koyama

(10) Patent No.: US 9,464,604 B2
(45) Date of Patent: Oct. 11, 2016

(54) INTAKE SYSTEM FOR INTERNAL COMBUSTION ENGINE

(71) Applicant: HONDA MOTOR CO., LTD., Tokyo (JP)

(72) Inventor: Shinya Koyama, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 118 days.

(21) Appl. No.: 13/955,462

(22) Filed: Jul. 31, 2013

(65) Prior Publication Data

US 2014/0041614 A1 Feb. 13, 2014

(30) Foreign Application Priority Data

Aug. 10, 2012 (JP) ..... 2012-178483

(51) Int. Cl.
*F02M 35/10* (2006.01)
*F02M 35/16* (2006.01)

(52) U.S. Cl.
CPC ..... *F02M 35/10* (2013.01); *F02M 35/1038* (2013.01); *F02M 35/10039* (2013.01); *F02M 35/162* (2013.01)

(58) Field of Classification Search
CPC ..... F02M 35/10; F02M 35/10085; F02M 35/10196; F02M 35/1038; F02M 35/10242
USPC ..... 123/184.21, 184.42, 184.53, 336
See application file for complete search history.

(56) References Cited

U.S. PATENT DOCUMENTS 6,196,186 B1 * 3/2001 Nagasaka ..... F02B 31/087 123/184.42

FOREIGN PATENT DOCUMENTS

FR WO 9708450 A1 * 3/1997 ..... F02F 7/006
JP 10-299535 A 11/1998
JP 10299535 A * 11/1998

* cited by examiner

*Primary Examiner* — Lindsay Low
*Assistant Examiner* — Omar Morales
(74) *Attorney, Agent, or Firm* — Squire Patton Boggs (US) LLP

(57) ABSTRACT

An intake system includes an intake passage for leading intake air to an internal combustion engine; an air cleaner connected to the upstream side end portion of the intake passage. A pressure sensor measures pressure of intake air in the intake passage. An air cleaner case includes a case main body mounted to the upstream side end portion of the intake passage. A cover portion closes the case main body. The intake system includes a throttle body constituting part of the intake passage and having a throttle valve. The pressure sensor is mounted to a support portion extending outward from the case main body and is connected to the downstream side of the throttle valve.

14 Claims, 6 Drawing Sheets

INTAKE SYSTEM FOR INTERNAL COMBUSTION ENGINE

BACKGROUND

1. Field

The present invention relates to intake systems for an internal combustion engine and in particular to an intake system for an internal combustion engine that has a pressure sensor for measuring the pressure of intake air supplied to an internal combustion engine.

2. Description of the Related Art

Vehicles such as automobiles, motorcycles and the like have heretofore been such that an intake system for an internal combustion engine is generally provided with a pressure sensor in order to statically or dynamically measure in an intake path the pressure of intake air supplied to the internal combustion engine. Means for supporting the pressure sensor of this type is known in which the pressure sensor is installed on the upper portion of a surge tank disposed on the upstream side of an intake path in order to eliminate piping and to prevent clogging resulting from foreign matter or from freezing, as discussed, for example, in Patent Document 1 (Japanese Patent Laid-Open No. Hei 10-299535).

If the surge tank is disposed on the upstream side of a throttle body in the intake path, the surge tank is sometimes designed to incorporate a purifying filter and function as an air cleaner. In this case, the air cleaner case (the surge tank) is configured to have a vertically divided structure to clean the purifying filter at regular intervals.

However, if the air cleaner case is configured to have the vertically divided structure, the pressure sensor may be disposed on the upper portion of the air cleaner case as in Patent Document 1 mentioned above. In such a case, it is necessary to remove the pressure sensor or to disconnect a cable extending from the pressure sensor when the air cleaner case is disassembled and cleaned. Thus, work for disassembling the air cleaner case is likely to be cumbersome.

SUMMARY

The present invention has been made in view of such situations and aims to provide an intake system for an internal combustion engine in which an air cleaner case can be disassembled without the removal of a pressure sensor and maintenance performance of an air cleaner can be improved.

To achieve the above object, according to certain embodiments of the invention, there is provided an intake system for an internal combustion engine including an intake passage connected to an intake port of the internal combustion engine and leading intake air to the intake port. An air cleaner is connected to an upstream side end portion of the intake passage, and a pressure sensor measures pressure of intake air in the intake passage. The air cleaner includes an air cleaner case and a purifying filter housed in the air cleaner case, and the air cleaner case includes a case main body mounted to an upstream side end portion of the intake passage. A cover portion covers and closes the case main body. The intake system includes a throttle body constituting part of the intake passage and having a throttle valve. The pressure sensor is mounted to a support portion extending outward from the case main body and is connected via a pipe line to a downstream side of the throttle valve of the throttle body.

In other embodiments, the support portion has a hollow joint portion which is formed integrally therewith and to which the pipe line is connected, and a detecting portion of the pressure sensor is connected to an end of the joint portion opposite to the pipe line.

In certain embodiments, a projecting portion extends parallel to the joint portion is formed on an outside portion of the joint portion of the support portion.

In certain embodiments, the projecting portion is set at a length greater than that of the joint portion.

In some embodiments, the support portion extends from a portion of a side surface of the case main body so as to be flush with and parallel to a mating surface between the case main body and the cover portion.

The internal combustion engine can have a plurality of cylinders; the throttle body can be connected to each of the plurality of cylinders, the pipe line can be connected to one of the plurality of throttle bodies, and the support portion can be disposed close to the throttle body to which the pipe line is connected.

The throttle body can have a fuel injection valve for injecting fuel into the intake passage, and the support portion can be disposed at a position covering above the fuel injection valve.

The pressure sensor can be secured to the support portion by means of a fastening member at a position in the support portion and between the case main body and the detecting portion of the pressure sensor.

The pressure sensor can be mounted to the support portion extending outward from the case main body and can be connected via the pipe line to the downstream side of the throttle valve of the throttle body. Therefore, the air cleaner case can be disassembled without the removal of the pressure sensor. Thus, the maintenance performance for the air cleaner can be improved.

The support portion can have the hollow joint portion which is formed integrally therewith and to which the pipe line is connected. The detecting portion of the pressure sensor can be connected to the end of the joint portion opposite to the pipe line. Therefore, it is not necessary to attach a joint portion as a separate member to the pressure sensor not equipped with a joint portion. Thus, the number of component parts can be reduced.

The projecting portion extending parallel to the joint portion can be formed on the outside portion of the joint portion of the support portion. Therefore, the joint portion of the support portion can be protected by the projecting portion.

The projecting portion can be set at a length greater than that of the joint portion. Therefore, in the case where the air cleaner is placed with the joint portion faced downward, the projecting portion comes into contact with e.g. its placing surface to prevent the end of the joint portion from coming into contact with the placing surface. Thus, the joint portion can further be protected.

The support portion can extend from a portion of a side surface of the case main body so as to be flush with and parallel to the mating surface between the case main body and the cover portion. Therefore, a split mold used to mold the case main body can be simplified. Thus, manufacturing costs can be reduced.

The pipe line can be connected to one of the plurality of throttle bodies and the support portion is disposed close to the throttle body to which the pipe line is connected. Therefore, the pipe line can be shortened. Thus, manufacturing costs can be reduced and the arrangement of the pipe line can be facilitated.

The support portion can be disposed at a position covering above the fuel injection valve. Therefore, the support portion can protect the fuel injection valve from above.

The pressure sensor can be secured to the support portion by means of a fastening member at a position in the support portion and between the case main body and the detecting portion of the pressure sensor. For example, if the fastening member is a bolt, a threaded hole for the bolt can be formed at a rigid portion of the support portion. Therefore, it is possible to suppress the flexure of the support portion during the machining of the threaded hole. Thus, machining accuracy can be improved.

DETAILED DESCRIPTION

Figure 1:
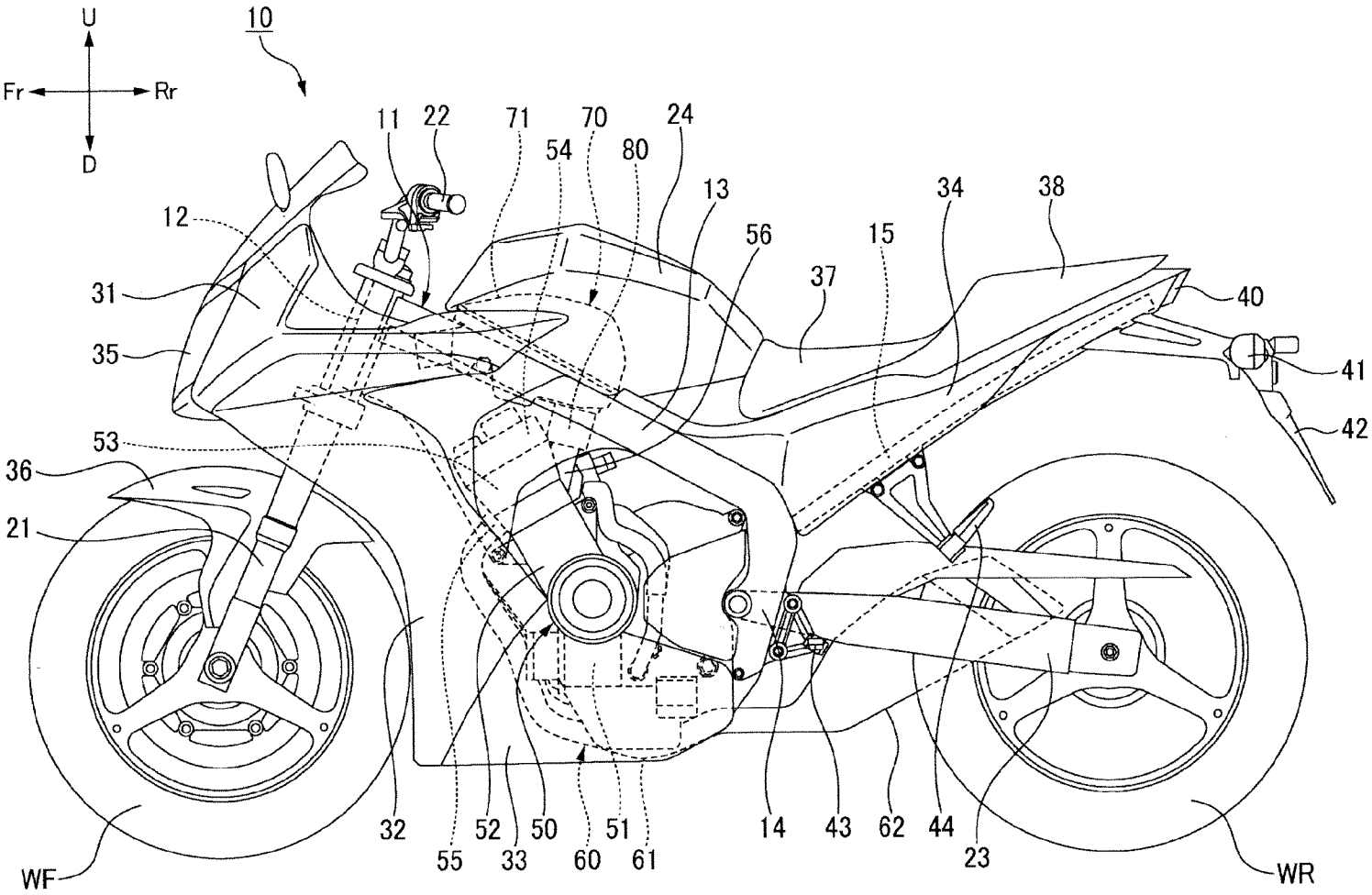
FIG. 1 is a left lateral view for assistance in explaining a motorcycle on which an intake system for an internal combustion engine according to embodiments of the present invention is mounted.

Embodiments of an intake system for an internal combustion engine according to the present invention will hereinafter be described in detail with reference to the drawings. Incidentally, the drawings shall be viewed based on the direction of reference symbols. In the following description, front and back or rear, left and right, and upside and downside depend on the direction a rider looks. In the drawings, the front of the vehicle is denoted by symbol Fr, the rear is denoted by symbol Rr, the left is denoted by symbol L, the right is denoted by symbol R, the upside is denoted by symbol U, and the downside is denoted by symbol D.

As shown in FIG. 1, a motorcycle 10 can be configured such that a body frame 11 includes a head pipe 12 installed at a front end thereof, and a pair of left and right main frames 13 extending rearward and downward from the head pipe 12. A pair of left and right pivot plates 14 are joined to the corresponding rear ends of the pair of left and right main frames 13 and extending downward. A pair of left and right seat frames 15 joined to the corresponding upper portions of the pair of left and right pivot plates 14 and extending rearward and upward. An engine, such as an internal combustion engine 50 is mounted on the main frames 13 and the pivot plates 14.

The motorcycle 10 includes a front fork 21 steerably supported by the head pipe 12, and a front wheel WF rotatably supported by a lower end of the front fork 21. A steering handlebar 22 is mounted to the upper end of the front fork 21, and a swing arm 23 is swingably supported by a pivot plate 14. A rear wheel WR is rotatably supported by the rear end of the swing arm 23, and a fuel tank 24 disposed above the engine 50.

There are shown in FIG. 1 a front cowl 31, a front side cowl 32, an under cowl 33, a rear cowl 34, a headlight 35, a front fender 36, a rider's seat 37, a pillion passenger's seat 38, a taillight 40, a rear direction indicator 41, a rear fender 42, a main step 43 and a pillion step 44.

The engine 50 is, in this example, a parallel four-cylinder engine. As shown in FIG. 1, its outer shell mainly includes a crankcase 51, a cylinder block 52 mounted on the front upper end portion of the crankcase 51, and a cylinder head 53 mounted on the upper end of the cylinder block 52. A cylinder head cover 54 covers the upper opening of the cylinder head 53. The engine 50 of the present embodiment is of a front-exhaust and rear-intake type. Therefore, four exhaust ports 55 are provided in the front surface of the cylinder head 53. In addition, four intake ports 56 are provided in the rear surface of the cylinder head 53. An exhaust system 60 is connected to the exhaust ports 55 of the engine 50. An intake system 70 is connected to the intake ports 56.

The exhaust system 60 includes an exhaust pipe 61 connected to the exhaust ports 55 of the engine 50 and extending rearward of the vehicle body, and a silencer 62 connected to the downstream end of the exhaust pipe 61.

Figure 2:
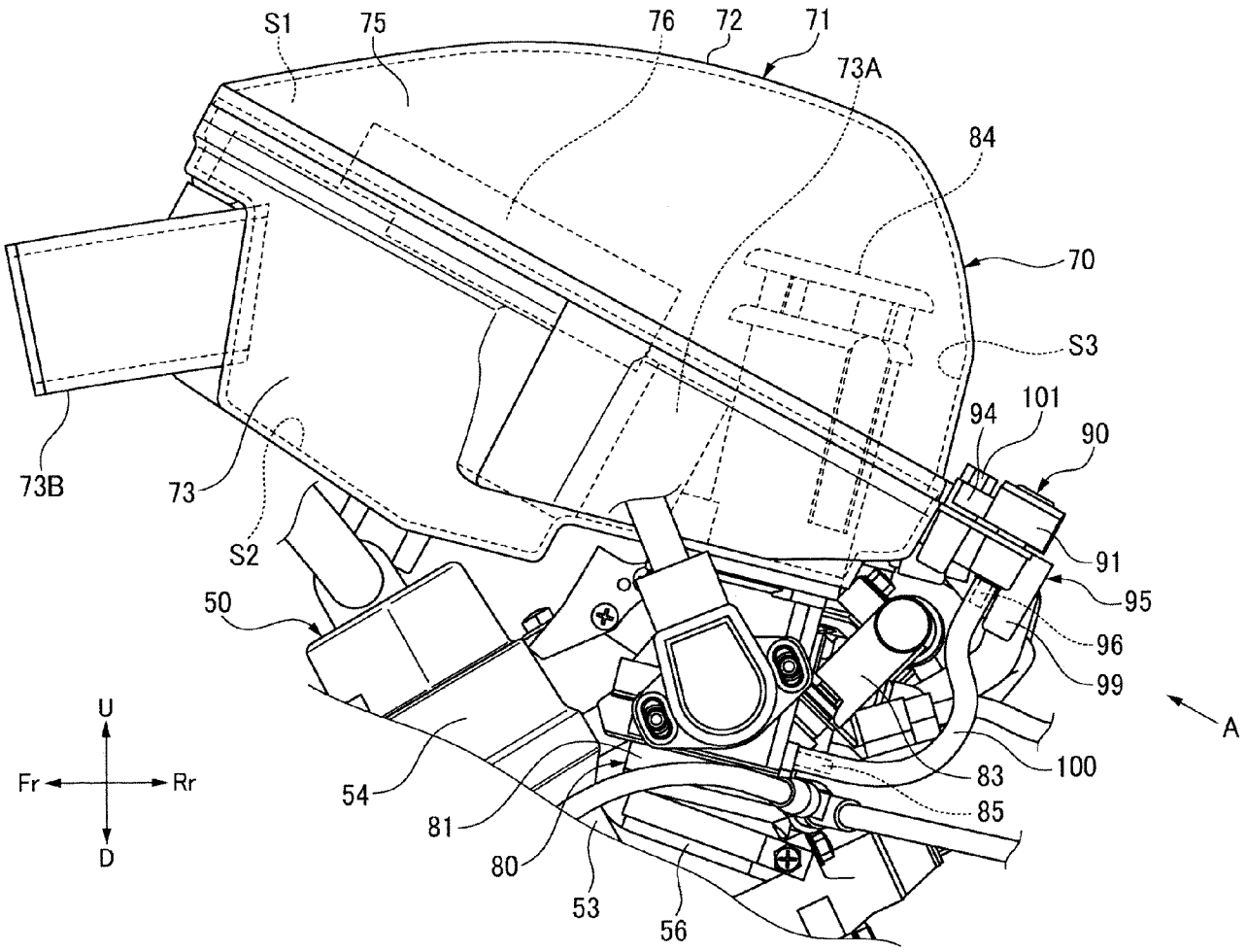
FIG. 2 is a left lateral view for assistance in explaining the intake system shown in FIG. 1.
Figure 3:
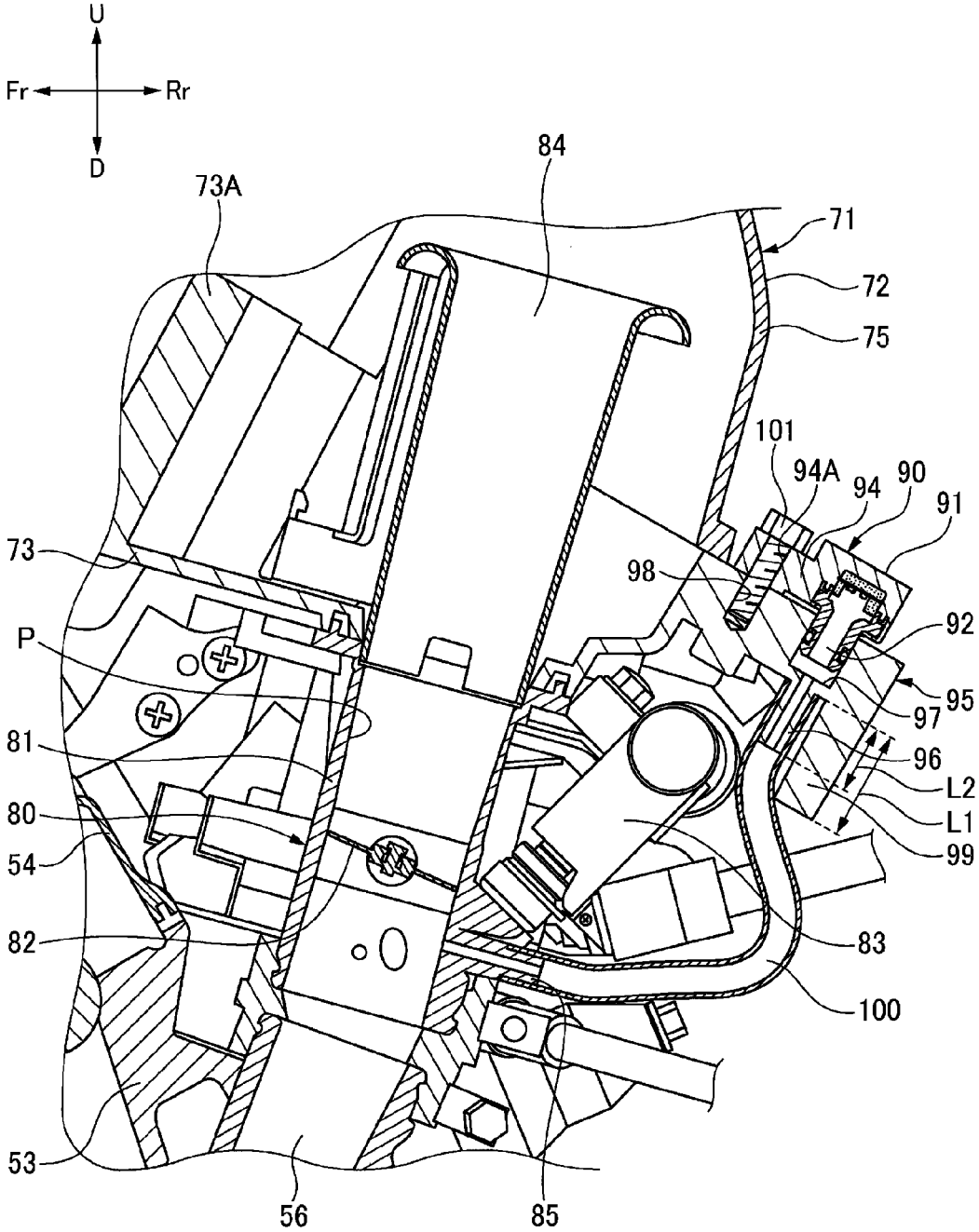
FIG. 3 is a cross-sectional view illustrating the periphery of a throttle body shown in FIG. 2, taken along line B-B in FIG. 5.

As shown in FIGS. 2 and 3, the intake system 70 is connected to the four intake ports 56 of the engine 50 and constitutes an intake passage P adapted to lead intake air to the intake ports 56. The intake system 70 has an air cleaner 71 connected to the upstream side end portion of the intake passage P, a throttle body 80 constituting part of the intake passage P, and a pressure sensor 90 for measuring the pressure of intake air in the intake passage P.

As shown in FIG. 2, the air cleaner 71 includes an air cleaner case 72 disposed just above the cylinder head cover 54 of the engine 50 and forming a chamber S1, and a purifying filter 76 housed in the air cleaner case. The air cleaner case 72 is formed to have a vertically divided structure, which has a bottomed and roughly bowl-like case main body 73 mounted to the upstream side end portion of the intake passage P and a dome-like cover portion 75 closing the case main body 73.

The case main body 73 has a partition 73A which sections the inside space thereof in an anteroposterior direction to form a front sectioned chamber S2 and a rear sectioned chamber S3 therein. An air duct 73B serving as a first outside air introduction passage is mounted to the front surface of the case body 73. The air duct 73B communicates with the front sectioned chamber S2. Intake air is taken in the intake passage P from the outside via the air duct 73B.

The purifying filter 76 is installed to cover above the front sectioned chamber S2 of the case main body 73. Because of this, intake air taken in from the air duct 73B first passes through the front sectioned chamber S2 of the case body 73, and further the purifying filter 76 and is then led to the inside space of the cover portion 75 and the rear sectioned chamber S3 of the case main body 73. That is to say, the front sectioned chamber S2 of the case main body 73 serves as a dirty chamber and the inside space of the cover portion 75 and the rear sectioned chamber S3 of the case main body 73 serves as a clean chamber.

Four throttle bodies 80 are installed to correspond to the associated cylinders of the engine 50. As shown in FIG. 2, the throttle body 80 is connected on its downstream side to each of the intake ports 56 and is connected on its upstream side to the air cleaner 71. As shown in FIGS. 2 and 3, the throttle body 80 includes a throttle body main body 81 having an inside space constituting part of the intake passage P. A throttle valve 82 is disposed inside the throttle body main body 81, for opening and closing the intake passage P. An injector (a fuel injection valve) 83 is for injecting fuel into the intake passage P. An air funnel 84 mounted to the upstream end of the throttle body main body 81. In the present embodiment, the intake passage P is composed of the air funnel 84, the throttle body main body 81, and the intake port 56.

Figure 4:
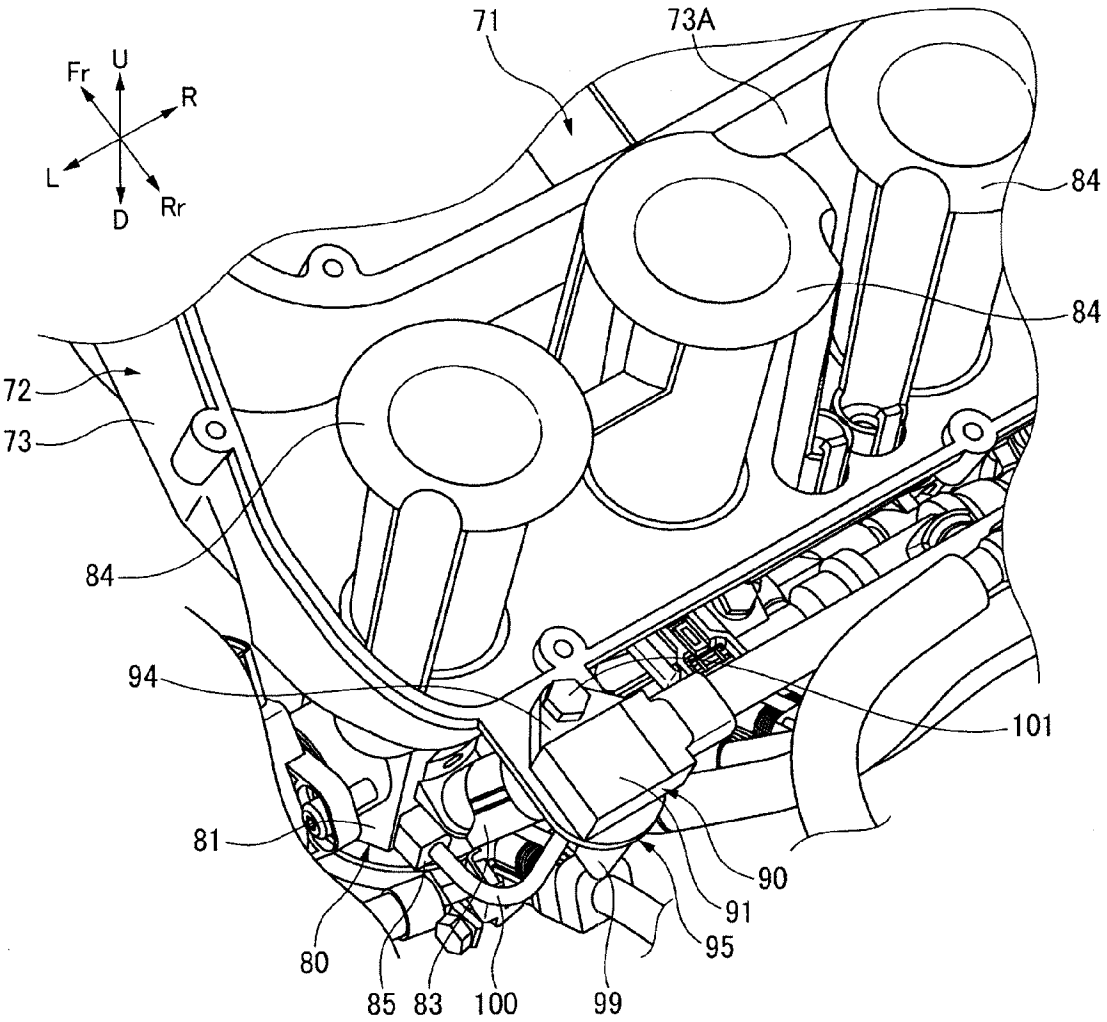
FIG. 4 is a perspective view illustrating the periphery of a pressure sensor shown in FIG. 3.
Figure 5:
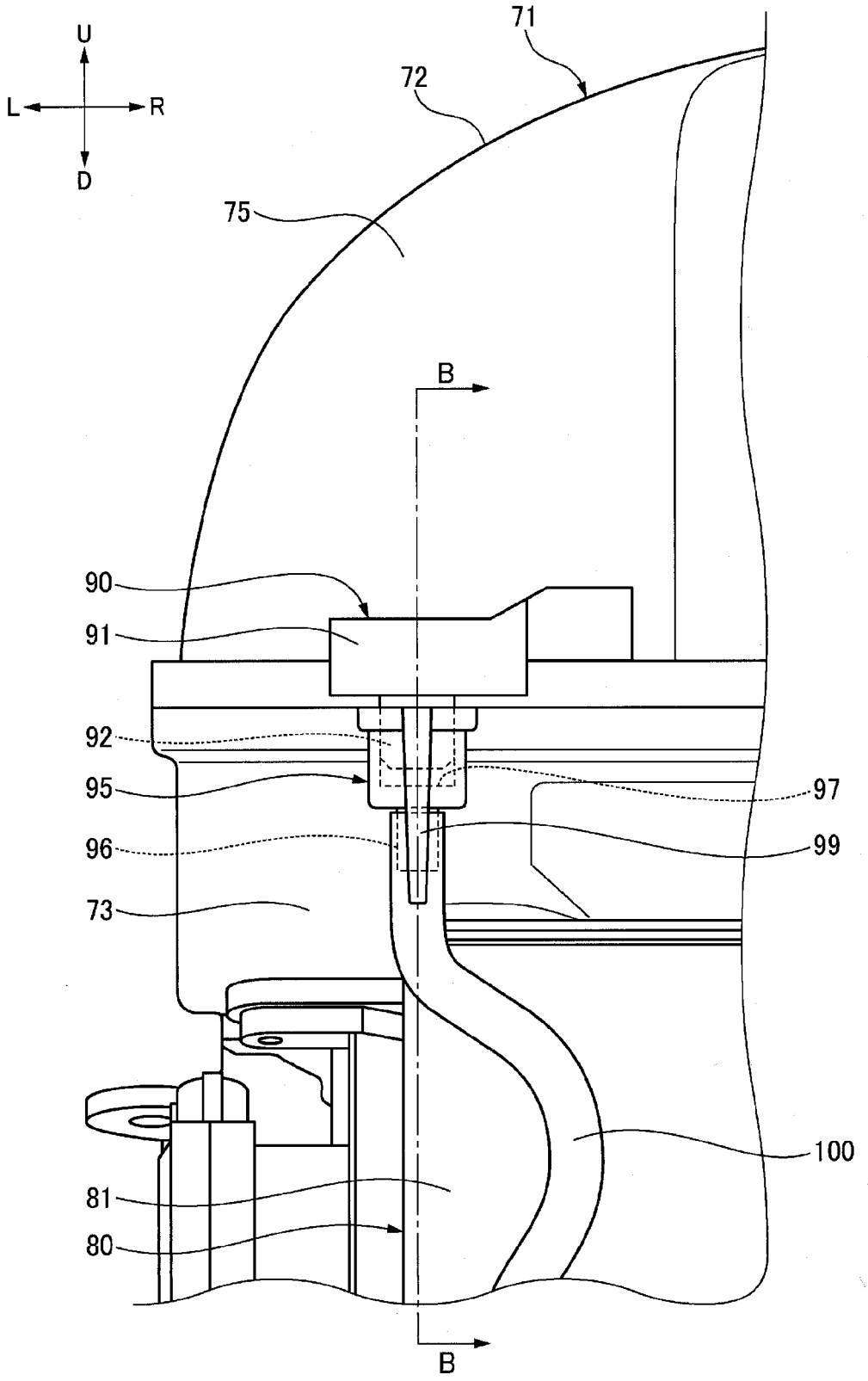
FIG. 5 is a rear view illustrating the periphery of the pressure sensor shown in FIG. 2, as viewed from arrow "A."

As shown in FIGS. 4 and 5, a cylindrical joint portion 85 is installed on the outer circumferential surface of the throttle body main body 81 of the throttle body 80 located on the most left side of the four throttle bodies 80 so as to extend toward the rear of the vehicle.

The joint portion 85 communicates with the intake passage P and is located on the downstream side of the throttle valve 82. A pipe line 100 connected to a joint portion 96 of a support portion 95 to be described later is connected to the joint portion 85.

Figure 6:
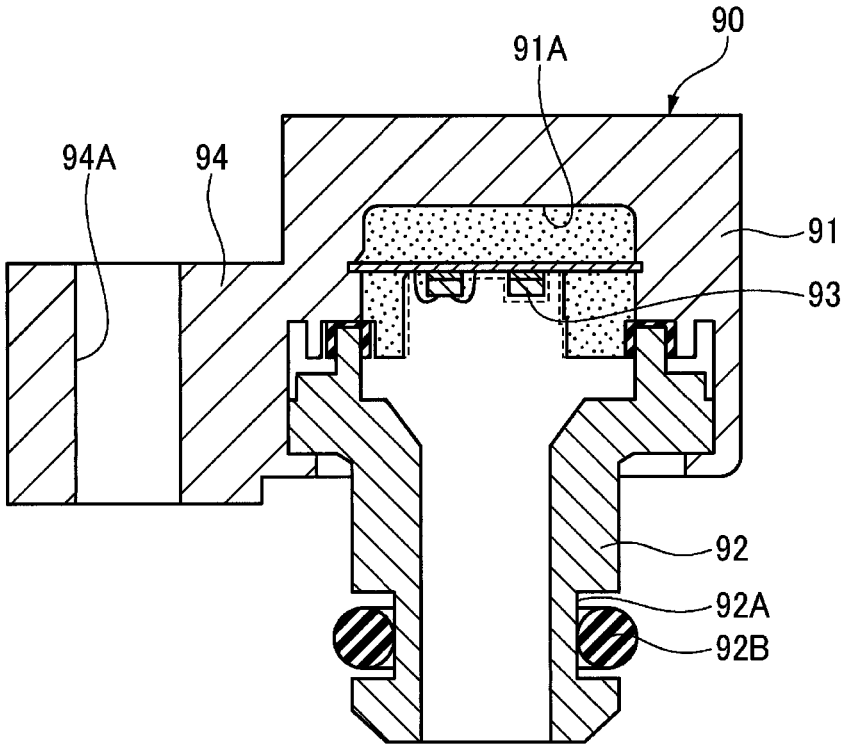
FIG. 6 is a cross-sectional view of the pressure sensor shown in FIG. 3.

As shown in FIG. 6, the pressure sensor 90 includes a sensor main body 91 provided with a recessed portion 91A on the rear surface side thereof. A cylindrical detecting portion 92 is joined to the sensor main body 91 so as to cover the recessed portion 91A of the sensor main body 91. A detecting element 93, which is composed of a piezo element and outputs to the outside an electric signal corresponding to pressure, is attached to the recessed portion 91A of the sensor main body 91.

A fastening portion 94 is installed on the side surface of the sensor main body 91 so as to extend toward the outside. The fastening portion 94 is formed with an insertion hole 94A used to pass therethrough a bolt (a fastening member) 101 to be described later. A circumferential groove 92A is formed in the outer circumferential surface of the end portion of the detecting portion 92 so as to extend over the whole circumference thereof. An O-ring 92B is attached to the circumferential groove 92A.

In the present embodiments, the cantilever-like support portion 95 is installed on the case main body 73 of the air cleaner 71 so as to extend rearward from a portion of the rear surface thereof as shown in FIGS. 2 to 5. The pressure sensor 90 is mounted to the support portion 95. As shown in FIGS. 4 and 5, the support portion 95 is disposed close to the throttle body 80 located on the most left side. In this way, the pressure sensor 90 of the present embodiment measures the pressure in the intake passage P of the throttle body 80 located on the most left side.

As shown in FIGS. 3 and 4, the support portion 95 is installed to extend flush with and parallel to the mating surface between the case main body 73 of the air cleaner case 72 and the cover portion 75. In addition, the support portion 95 is disposed at a position covering above the injector 83 of the throttle body 80.

The downwardly extending cylindrical joint portion 96 connected to the pipe line 100 is integrally formed with the lower surface of the near-end portion of the support portion 95. The detecting portion 92 of the pressure sensor 90 is fitted to and joined to an end of the joint portion 96 opposite to the pipe line 100, i.e., the upper surface portion of the support portion 95 to form a fitting recessed portion 97 communicating with the inside space of the joint portion 96. In this way, the detecting portion 92 of the pressure sensor 90 is connected via the pipe line 100 to the joint portion 85 of the throttle body 80 located on the most left side.

As shown in FIGS. 2 to 5, a projecting portion 99 extending parallel to the joint portion 96 is formed at an end portion (an outside portion), extending from the joint portion 96, of the support portion 95. As shown in FIG. 3, the projecting portion 99 is set at a length L1 greater than a length L2 of the joint portion 96 of the support portion 95.

As shown in FIG. 3, the support portion 95 is formed with a threaded hole 98 between the case main body 73 of the air cleaner 71 and the detecting portion 92 of the pressure sensor 90. The fastening portion 94 of the pressure sensor 90 connected to the fitting recessed portion 97 is fixedly fastened to the support portion 95 by the bolt 101 passed through the insertion hole 94A of the fastening portion 94 and the threaded hole 98.

As described above, according to the intake system 70 of the present embodiments, the pressure sensor can be mounted on the support portion 95 extending outward from the case main body 73 and is connected via the pipe line 100 to the downstream side of the throttle valve 82 of the throttle body 80. Therefore, the air cleaner case 72 can be disassembled without removal of the pressure sensor 90. Thus, the maintenance performance of the air cleaner 71 can be improved.

The support portion 95 can have the joint portion 96 formed integrally therewith and connected to the pipe line 100. In addition, the detecting portion 92 of the pressure sensor 90 is connected to the end of the joint portion 96 opposite to the pipe line 100. Therefore, it is not necessary to attach a joint portion as a separate member to the pressure sensor 90 not equipped with a joint portion. Thus, the number of component parts can be reduced. Since the joint portion 96 can easily be formed on the support portion 95 by e.g. resin molding or the like, manufacturing costs for a vehicle can be reduced.

The projecting portion 99 extending parallel to the joint portion 96 can be formed at a portion of the support portion 95 on the outside of the joint portion 96. Therefore, the joint portion 96 of the support portion 95 can be protected by the projecting portion 99.

The projecting portion 99 can be set at a length L1 greater than the length L2 of the joint portion 96. Therefore, if the air cleaner 71 is placed with the joint portion 96 oriented downward, the projecting portion 99 comes into contact with e.g. its placing surface to prevent the end of the joint portion 96 from coming into contact with the placing surface. Thus, the joint portion 96 can further be protected.

The support portion 95 can be installed to extend from a portion of a side surface of the case main body 73 so as to be flush with and parallel to the mating surface between the case main body 73 and the cover portion 75. Therefore, a split mold used to mold the case main body 73 can be simplified. Thus, manufacturing costs can be reduced.

The pipe line 100 can be connected to one of the four throttle bodies 80 and the supporting portion is disposed close to the throttle body 80 to which the pipe line 100 is connected. Therefore, the pipe line 100 can be shortened. Thus, manufacturing costs can be reduced and the arrangement of the pipe line 100 can be facilitated.

The support portion 95 can be disposed at a position covering above the injector 83. Therefore, the support portion 95 can protect the injector 83 from above.

The pressure sensor 90 is secured to the support portion 95 by means of the bolt 101 at a position in the support portion 95 and between the case main body and the detecting portion 92 of the pressure sensor 90. Therefore, the threaded hole 98 can be formed at a rigid portion of the support portion 95. Therefore, the flexure of the support portion 95 can be suppressed during the machining of the threaded hole. Thus, machining accuracy can be improved.

The present invention is not limited to the exemplification of the embodiments described above. The present invention can arbitrarily be modified in a range not departing from the gist of the present invention.

DESCRIPTION OF REFERENCE SYMBOLS

10 Motorcycle
50 Engine (internal combustion engine)
56 Intake port
70 Intake system
71 Air cleaner
72 Air cleaner case
73 Case main body
75 Cover portion
76 Purifying filter
80 Throttle body
2 Throttle valve
83 Injector (fuel injection valve)
90 Pressure sensor
92 Detecting portion
95 Support portion
96 Joint portion
99 Projecting portion
100 Pipe line
101 Bolt (fastening member)
P Intake passage
L1 Length of the projecting portion
L2 Length of the joint portion

The invention claimed is:

1. An intake system for an internal combustion engine, said intake system comprising:

an intake passage connected to an intake port of the internal combustion engine and leading intake air to the intake port;

an air cleaner connected to an upstream side end portion of the intake passage; and a pressure sensor configured to measure pressure of intake air in the intake passage, wherein the air cleaner includes an air cleaner case and a purifying filter housed in the air cleaner case, and wherein the air cleaner case includes a case main body mounted to an upstream side end portion of the intake passage, and a cover portion closing the case main body, wherein the intake system includes a throttle body constituting part of the intake passage, and having a throttle valve, wherein the pressure sensor is mounted to a support portion extending outward from the case main body and is connected via a pipe line to a downstream side of the throttle valve of the throttle body, and wherein the support portion extends from a portion of a side surface of the case main body so as to be flush with and parallel to a mating surface between the case main body and the cover portion.

2. The intake system for an internal combustion engine according to claim 1, wherein the support portion has a hollow joint portion which is formed integrally therewith and to which the pipe line is connected, and a detecting portion of the pressure sensor is connected to an end of the joint portion opposite to the pipe line.

3. The intake system for an internal combustion engine according to claim 2, wherein a projecting portion extending parallel to the joint portion is formed on an outside portion of the joint portion of the support portion.

4. The intake system for an internal combustion engine according to claim 3, wherein the projecting portion has a length which is greater than a length of the joint portion.

5. The intake system for an internal combustion engine according to claim 2, wherein the internal combustion engine has a plurality of cylinders, the throttle body is connected to each of the plurality of cylinders, the pipe line is connected to one of the plurality of throttle bodies, and wherein the support portion is disposed close to the throttle body to which the pipe line is connected.

6. The intake system for an internal combustion engine according to claim 5, wherein the throttle body has a fuel injection valve for injecting fuel into the intake passage, and wherein the support portion is disposed at a position covering above the fuel injection valve.

7. The intake system for an internal combustion engine according to claim 2, wherein the pressure sensor is secured to the support portion by a fastening member at a position in the support portion and between the case main body and the detecting portion of the pressure sensor.

8. An intake system for an internal combustion engine, said intake system comprising:

intake means for leading intake air into an intake port of the internal combustion engine;

cleaning means for cleaning intake air connected to an upstream side end portion of the intake passage; and measuring means for measuring pressure of the intake air in the intake passage means, wherein the cleaning means includes an air cleaner case and a purifying means for filtering air housed in the air cleaner case, and wherein the air cleaner case includes a case main body mounted to an upstream side end portion of the intake means, and a covering means for closing the case main body, wherein the intake system includes throttling means for throttling, said throttling means constituting part of the intake means, and having a throttle valve therein, wherein the measuring means is mounted to a support portion extending outward from the case main body and is connected via a pipe line to a downstream side of the throttle valve of the throttling means, and wherein the support portion extends from a portion of a side surface of the case main body so as to be flush with and parallel to a mating surface between the case main body and the covering means.

9. The intake system for an internal combustion engine according to claim 8, wherein the support portion has a hollow joint portion which is formed integrally therewith and to which the pipe line is connected, and a detecting portion of the pressure sensor means is connected to an end of the joint portion opposite to the pipe line.

10. The intake system for an internal combustion engine according to claim 9, wherein a projecting portion extending parallel to the joint portion is formed on an outside portion of the joint portion of the support portion.

11. The intake system for an internal combustion engine according to claim 10, wherein the projecting portion has a length which is greater than a length of the joint portion.

12. The intake system for an internal combustion engine according to claim 9, wherein the internal combustion engine has a plurality of cylinders, the throttling means comprising a plurality of throttle bodies, with a throttle body being connected to each of the plurality of cylinders, the pipe line is connected to one of the plurality of throttle bodies, and wherein the support portion is disposed close to the throttle body to which the pipe line is connected.

13. The intake system for an internal combustion engine according to claim 12, wherein the throttling means has a fuel injection valve means for injecting fuel into the intake means, and wherein the support portion is disposed at a position covering above the fuel injection valve means.

14. The intake system for an internal combustion engine according to claim 9, wherein the measuring means is secured to the support portion by a fastening member at a position in the support portion and between the case main body and the detecting portion of the measuring means.

* * * * *